US011859614B2

(12) United States Patent
Kadam et al.

(10) Patent No.: US 11,859,614 B2
(45) Date of Patent: Jan. 2, 2024

(54) REVERSIBLE GEROTOR PUMP SYSTEM

(71) Applicant: Eaton Intelligent Power Limited, Dublin (IE)

(72) Inventors: Hemant Rajaram Kadam, Satara (IN); Vipin Nivrutti Rane, Pune (IN); Shrikrishna Deshpande, Pune (IN); Mayur Keshav Bhure, Pune (IN); Satalingayya C. Hiremath, Pune (IN); Shivayogi Sidram Salutagi, Pune (IN); Rohit Kumar Maurya, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/758,192

(22) PCT Filed: Dec. 30, 2020

(86) PCT No.: PCT/EP2020/025602

§ 371 (c)(1),
(2) Date: Jun. 29, 2022

(87) PCT Pub. No.: WO2021/136589

PCT Pub. Date: Jul. 8, 2021

(65) Prior Publication Data

US 2023/0022514 A1 Jan. 26, 2023

(30) Foreign Application Priority Data

Dec. 31, 2019 (IN) ..... 201911054619
Nov. 10, 2020 (IN) ..... 202011049065

(51) Int. Cl.
*F03C 2/00* (2006.01)
*F03C 4/00* (2006.01)
(Continued)

(52) U.S. Cl.
CPC ..... *F04C 14/04* (2013.01); *F01C 20/04* (2013.01); *F04C 2/102* (2013.01); *F04C 15/0065* (2013.01)

(58) Field of Classification Search
CPC ..... F04C 2/102; F04C 14/04; F04C 15/064; F04C 15/0061; F04C 15/0065; F04C 15/008; F01C 20/04; F01C 2021/1675
See application file for complete search history.

(56) References Cited

U.S. PATENT DOCUMENTS 2,458,678 A * 1/1949 Bunte ..... F04C 14/04 418/32
4,171,192 A 10/1979 Taylor et al.
(Continued)

FOREIGN PATENT DOCUMENTS

CN 101253329 A 8/2008
CN 104514711 A 4/2015
(Continued)

OTHER PUBLICATIONS

DE1553281A1—Kehrer Georg—Kapselwerk,insbesondere Raederkapselwerk—Sep. 25, 1969—the Machine English Translation. (Year: 1969).*
(Continued)

*Primary Examiner* — Theresa Trieu
(74) *Attorney, Agent, or Firm* — Talem IP Law, LLP

(57) ABSTRACT

A reversible gerotor pump system is provided. The gerotor pump system includes a cylindrical housing with a 180° slot, an eccentric ring with a locking pin fixed thereto and movably engaged in the slot; an outer rotor and inner rotor with meshed teeth, and shaft for driving inner rotor and system. The eccentric ring has a convex profile on the outer diameter. A positive contact system, which can be a spring-and-plunger system or frictional disc brake system is provided to increase frictional force between the eccentric ring
(Continued)

and the outer rotor. The locking pin moves in the slot with clearance at both rotation directions to provide a self-damping effect. The suction port has prolongations at both upstream and the downstream sides to increase filling time such that the pump can have a fill speed of above 5000 rpm, and the volumetric efficiency is at least 90% at 5000 rpm.

14 Claims, 13 Drawing Sheets

(51) Int. Cl.

| | |
|---|---|
| ***F04C 2/00*** | (2006.01) |
| ***F04C 18/00*** | (2006.01) |
| ***F04C 14/04*** | (2006.01) |
| ***F04C 2/10*** | (2006.01) |
| ***F04C 15/00*** | (2006.01) |
| ***F01C 20/04*** | (2006.01) |

(56) References Cited

U.S. PATENT DOCUMENTS

| | | | | |
|---|---|---|---|---|
| 4,200,427 | A | 4/1980 | Binger et al. | |
| 4,222,719 | A | 9/1980 | Johnson | |
| 4,944,662 | A | 7/1990 | Child | |
| 5,702,319 | A * | 12/1997 | Baxter, Jr. | F04C 14/04 418/32 |
| 5,711,408 | A | 1/1998 | Dick | |
| 6,149,410 | A | 11/2000 | Cooper | |
| 10,119,539 | B2 | 11/2018 | Schweiher et al. | |
| 10,895,257 | B2 | 1/2021 | Parrish et al. | |
| 2006/0029509 | A1 | 2/2006 | Kurata et al. | |
| 2010/0215537 | A1 * | 8/2010 | Chang | F04C 2/102 418/61.3 |
| 2015/0086403 | A1 | 3/2015 | Schweiher et al. | |
| 2019/0017161 | A1 * | 1/2019 | Holly | C23C 8/58 |
| 2019/0249663 | A1 | 8/2019 | Parrish et al. | |

FOREIGN PATENT DOCUMENTS

| | | | | |
|---|---|---|---|---|
| CN | 109252134 | A | 1/2019 | |
| CN | 110159527 | A | 8/2019 | |
| DE | 1553281 | A1 | 9/1969 | |
| DE | 102019102991 | B4 * | 5/2021 | F04C 15/00 |
| WO | 2006136014 | A1 | 12/2006 | |

OTHER PUBLICATIONS

DE-102019102991B4—Parrish et al.—Lubrication Strategy for a Dry-running Pump System—May 12, 2021—the Machine English Translation. (Year: 2021).*

International Search Report and Written Opinion for PCT/EP2020/025602; dated Feb. 24, 2021; pp. 1-9.

Search Report issued in Chinese Application No. 2020800940947, dated Jun. 27, 2023, 3 pages.

* cited by examiner

REVERSIBLE GEROTOR PUMP SYSTEM

CROSS REFERENCE TO RELATED APPLICATIONS

This is a United States § 371 National Stage Application of PCT/EP2020/025602 filed Dec. 30, 2020 which claims priority to Indian provisional patent application numbers 201911054619 filed on Dec. 31, 2019 and 202011049065 filed on Nov. 10, 2020. Both Indian priority patent applications and the Patent Cooperation Treaty Application are incorporated herein by reference.

FIELD OF TECHNOLOGY

The present invention relates to a lubrication pump for providing pressurized hydraulic fluid, and more particularly to a reversible gerotor pump system. Exemplary applications include use in a transmission for a heavy duty electric vehicle.

BACKGROUND

Reversible gerotor pumps conventionally include an externally toothed inner rotor surrounded by and meshing with an internally toothed outer rotor, both of which rotate together in the same direction about spaced parallel axes. The inner rotor generally has one fewer tooth than the outer rotor. The shaping of the teeth on the inner and outer rotors is such that as the two rotate together, they produce a pumping action. In a normal non-reversible type pump, if the direction of rotation of the inner and outer rotors is reversed, then the pumping action is reversed in that the pump inlet becomes a pump outlet and vice versa; however, if the eccentricity of the axes of the inner and outer rotors is reversed, then the pumping flow is correspondingly reversed. Based on the knowledge, reversible gerotor pumps have been designed that, when the reversal of rotation of the inner and outer rotors occurs, the eccentricity is also reversed, and as the result, irrespective of the change in the rotation direction, the pumping flow direction stays the same and the pump inlet remains an inlet while the pump outlet remains an outlet.

Conventionally, eccentricity reversal is achieved by movement of a reversing ring, also called an eccentric ring, within which the rotor of the pump is mounted. The eccentric ring is mounted for rotation about an axis co-extensive with the axis of the inner rotor of the pump and has an eccentrically positioned cylindrical bore within which the cylindrical outer surface of the outer rotor is received. Thus, the angular position of the reversing ring determines the eccentricity of the rotor relative to the inner rotor and moving the ring relative to the rotor through 180° reverses the eccentricity of the outer rotor relative to the inner rotor. Conventionally, frictional drag between the outer rotor and the reversing ring moves the reversing ring when reversal of the rotation of the outer rotor takes place, an outer housing providing abutments cooperating with the reversing ring to limit the movement of the reversing ring to 180°. See variations of such arrangements as illustrated in U.S. Pat. Nos. 4,171,192, 4,200,427, 4,222,719, 4,944,662, 5,711,408, and 6,149,410.

During the operation, the supply of liquid from the lubrication pump is crucial and any delay in pumping could be disastrous. While ensuring sufficient frictional drag between the outer rotor and the reversing ring so that the reversing ring is driven against its appropriate abutment immediately when the rotor commences reversal rotation, the frictional drag between the outer rotor and the eccentric ring may carry the risk of wear of the sliding interfaces and fracture, which can be extremely disadvantageous and result in the loss of frictional drag and delay in the supply of liquid from the pump. Moreover, wear and fracture cause contaminants in the liquid flow from the pump which could prevent appropriate movement of the reversing ring relative to the outer housing. Therefore, interaction between the eccentric ring and housing and rotors needs to be carefully designed to ensure movement yet avoid the disadvantages.

Further, the suction port is an important feature of a gerotor pump as it decides the filling capability of cavity and helps to prevent cavitation. Meshed teeth of the inner and outer rotors form a region which is called a cavity and the cavity expands in one side and contracts in other side of the housing as rotation of both rotor advances. Multiple cavities are formed between the meshed teeth. As the rotors rotate, the cavity expands and accordingly, sucks up the fluid from the suction port; it leaves the suction port when maximum volume reached, and compression starts. At any angular position of rotation, cavity should not connect discharge and suction ports at the same time to avoid inter-porting losses from higher pressure region of discharge port to lower pressure region of suction port.

SUMMARY

The disclosure provides a reversible gerotor pump to solve the disadvantages and ensure effective reversible rotation operation using the same suction and discharge ports. Further, the reversible gerotor pump is enabled to run at higher operating speed of above 5000 rpm and higher volumetric efficiency of more than 95%.

A reversible gerotor pump system comprises a cylindrical housing comprising a slot of 180 degree along a periphery of the housing, and the slot being defined by a first end at top and a second end at bottom; an eccentric ring positioned within the housing with a radial clearance C3 between the eccentric ring and the housing; a locking pin being fixed to the eccentric ring and movably engaged between the first end and the second end in the slot; an outer rotor positioned within the eccentric ring with a radial clearance C2 between the eccentric ring and the outer rotor, the outer rotor being eccentric with the eccentric ring and comprising a plurality of internal teeth with recesses between adjacent teeth; an inner rotor positioned within the outer rotor, the inner rotor comprising a plurality of external teeth, wherein at least a portion of the external teeth of the inner rotor are engaged with at least a portion of the internal teeth of the outer rotor, and the inner rotor and the outer rotor are eccentric relative to one another with an inner rotor tip clearance Ci being defined as a radial clearance between a tip of the external teeth and corresponding portion of the outer rotor, and the plurality of meshed teeth of the inner rotor and the outer rotor form a plurality of cavities that expand and contract as the shaft, inner rotor, and outer rotor rotate; a shaft being coupled with the inner rotor for rotatably driving the inner rotor with a radial clearance C1 between the shaft and the inner rotor; a suction port for providing hydraulic fluid to the cavity being expanded; and a discharge port for discharging hydraulic fluid from the cavity being contracted. In the pump system, the locking pin stops at the first end to stop rotation of the eccentric ring when the shaft rotates in clockwise direction in a first position; when the shaft rotates in reverse direction, the eccentric ring is driven to rotate in counter-clockwise rotation direction by contact force between the eccentric ring and the outer rotor to pass through a second position where the eccentric ring, the inner rotor, and the outer rotor rotate as one part along with the shaft, and the radial clearance C3 is greater than the sum of C1, C2, and Ci in the second position; the locking pin stops at the second end to stop rotation of the eccentric ring when the shaft rotates in the counterclockwise direction in a third position; and the suction port and the discharge port respectively function for sucking and discharging a hydraulic fluid unidirectionally in both clockwise and counterclockwise rotation directions.

The gerotor can be configured so that the interior diameter contact is present at radial clearances C1 and C2 at the second position.

The gerotor can be configured so that the eccentric ring is of convex profile on outer diameter.

The reversible gerotor pump system can further comprise a positive contact system that increases frictional force between an interior side of the eccentric ring and the outer rotor for rotation.

In one embodiment of the positive contact system for the reversible gerotor pump system, the positive contact mechanism can be a spring-and-plunger system that comprises a cavity at the interior side of the eccentric ring, a spring inside the cavity in a constantly compressed state, and a plunger inside the cavity and being constantly pressed by the spring, where compression of the spring applies a load N on the outer rotor through the plunger, and friction force F' of formula $F'=\mu*N$, $\mu$ is a coefficient of the frictional contact, is applied to rotate the eccentric ring with the outer rotor and inner rotor during rotation direction change.

In the embodiment, the plunger can be coated with a Ferritic Nitro-Carburizing (FNC) friction coating. Optionally, the cavity is formed by a drill through hole in the eccentric ring with a cap added at the outer diameter of the eccentric ring.

In another embodiment of the positive contact system for the reversible gerotor pump system, the positive contact mechanism can be a frictional disc brake type mechanism comprising spring, piston, and pads, and the frictional disc brake system provides spring force to hold the eccentric ring and the outer rotor at the second position, and outlet pressure releases pads and allow the eccentric ring and the outer rotor to rotate freely in the first and third positions.

The gerotor can be configured so that the locking pin moves in the slot with clearance at both clockwise and counterclockwise directions to provide a self-damping effect to avoid loading impact.

The gerotor can be configured so that the suction port for the pump can further comprises prolongations at the upstream side and the downstream side. By using the design of the suction port, the reversible gerotor pump can have a fill speed of above 5000 rpm, and the volumetric efficiency is at least 90% at 5000 rpm.

A transmission system for vehicles can comprise the reversible gerotor pump system. The transmission system can be configured so that the inlet and outlet ports remain as connected and do not need to be reversed when the inner rotor reverses rotation direction.

The gerotor can be configured in an electric vehicle comprising the transmission system of the present invention. The electric vehicle can be a heavy duty truck.

BRIEF DESCRIPTION OF THE DRAWINGS

FIG. 1A shows the first position where the locking pin stops at the first end of the 180° slot and the eccentric ring rotation stops at the top when the shaft rotates clockwise; FIG. 1B shows the second position, which is an intermediate position, where the eccentric ring, outer rotor, and inner rotor rotate as one part with the shaft; and FIG. 1C shows the third position where the locking pin stops at the second end of the 180° slot and the eccentric ring rotation stops at the bottom when the shaft rotates counterclockwise.

FIG. 2A shows the side view of the eccentric ring, and FIG. 2B shows the cross-sectional view of the eccentric ring along A-A' line.

FIG. 3A is a sectional view, FIG. 3B is a side view, and FIG. 3C is a partial enlarged view of the showing the spring-and-plunger arrangement in FIGS. 3A and 3B.

FIG. 4A shows the spring, piston, and pads acting on the pump, FIG. 4B shows the spring holding eccentric ring and outer rotor together with help of pads and spring force at the second position, and FIG. 4C shows that outlet pressure releases pad and allow the eccentric ring and outer rotor to rotate freely in the first and third positions.

FIG. 8A shows the suction port with prolongations, and FIG. 8B shows the prolongations in connection with changes in the cavity for suction.

FIG. 9A shows the top view of the pump and suction and discharge ports, and FIG. 9B shows the cross-sectional view of the pump and suction and discharge ports along E-E' line in FIG. 9A.

FIG. 10A shows the view of vapor fraction at 0 degree in the conventional gerotor pump, FIG. 10B shows the view of vapor fraction at 30 degree in the conventional gerotor pump, FIG. 10C shows the view of vapor fraction at 60 degree in the conventional gerotor pump, FIG. 10D shows the view of vapor fraction at 0 degree in the reversible gerotor pump with the suction port of the present disclosure, FIG. 10E shows the view of vapor fraction at 30 degree in the reversible gerotor pump with the suction port of the present disclosure, and FIG. 10F shows the view of vapor fraction at 60 degree in the reversible gerotor pump with the suction port of the present disclosure.

Figure 1B:
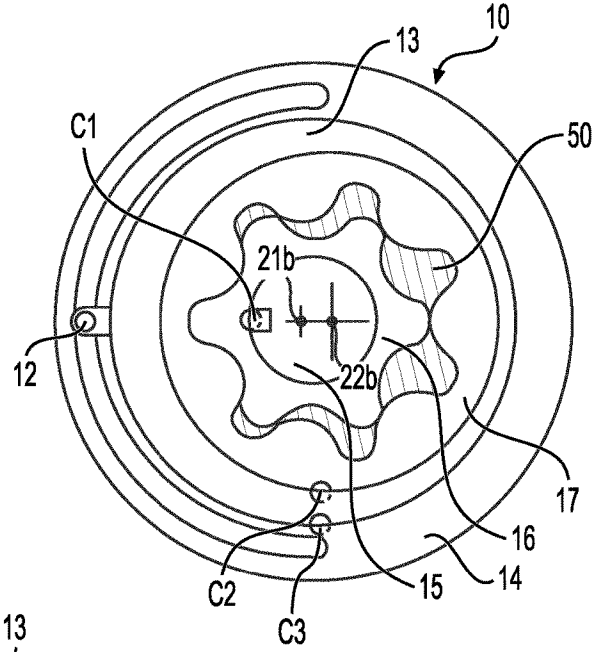
FIGS. 1A to 1C are sectional views showing the positions of the reversible gerotor pump in operation, where

Reference numerals used in the figures correspond to the following structures: 10—reversible gerotor pump; 11—slot; 11*a*—first end of slot; 11*b*—second end of slot; 12—locking pin; 13—eccentric ring; 14—housing; 15—shaft; 16—inner rotor; 17—outer rotor; 18—inlet direction; 18'—direction from inlet to the pump; 19—outlet direction; 20—outer plate; 21*a*, 21*b*, 21*c*—axle center for shaft at different positions; 22*a*, 22*b*, 22*c*—axle center for outer rotor at different positions;

C1—radial clearance between shaft and inner rotor; C2—radial clearance between outer rotor and interior of the eccentric ring; C3—radial clearance between interior of the housing and exterior of the eccentric ring; D1, D2—arrows showing direction of movement and clearance through slot;

30—suction port; 30*a*—upstream side; 30*b*—downstream side; 31, 31'—prolongation; 32—discharge port; 40—cavity for discharge; 50, 50'—cavity for suction; 60—external tooth of inner rotor; 71—inner tooth of outer rotor; 72—recess area between inner teeth of outer rotor;

100—positive contact mechanism; 101, 101'—spring; 102—plunger; 103—cavity; 104—piston; 105—pads; 111—linear line; 112—2% drop line; 113—computational fluid dynamic (CFD) line; 121—fill speed curve for the gerotor pump of the present disclosure; 122—fill speed curve for the conventional gerotor pump; 123—volumetric efficiency curve for the gerotor pump of the present disclosure; 124—volumetric efficiency curve for the conventional gerotor pump; 131, 132—convex outer surfaces of the eccentric ring.

DETAILED DESCRIPTION

Existing truck transmission has only unidirectional lubrication pump. However, in some applications, it is desired to remove the reverse gear. Now, when the heavy duty electric vehicle has no reverse gear mechanism, the transmission for the electric vehicle must have a lubrication pump with the ability to work in both clockwise and counterclockwise rotation directions while using the same ports for suction and discharge of the hydraulic fluid unidirectionally.

Figure 11:
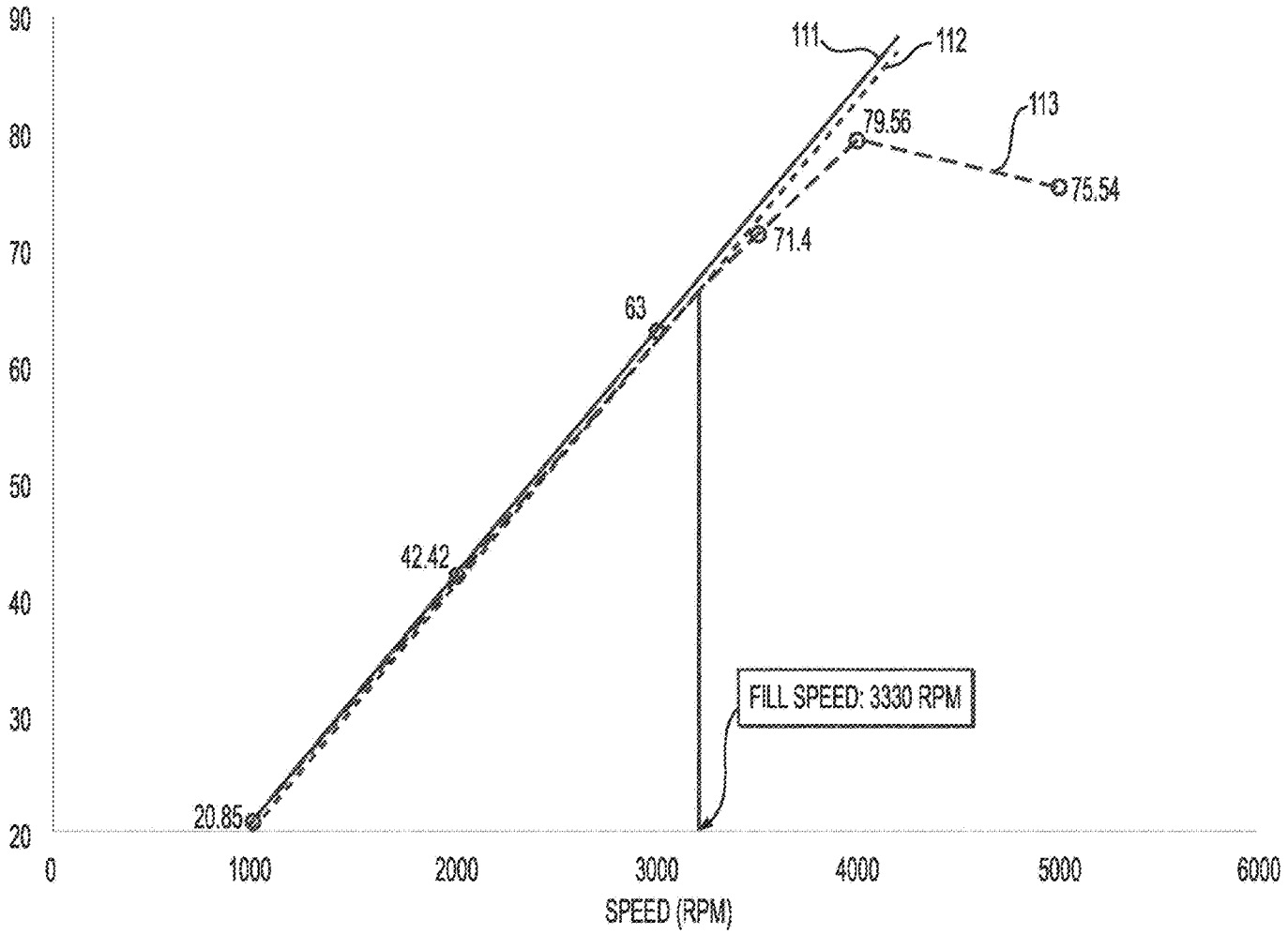
FIG. 11 PRIOR ART
FIG. 11 is a diagram showing the fill speed curve for the conventional gerotor pump, where the vertical axis shows the flow rate (LPM) and the vertical line shows the fill speed; 111 shows the linear line, 112 shows 2% drop line, and 113 shows the computational fluid dynamic (CFD) line.

Reversible gerotor pumps are designed for supplying hydraulic fluid for the vehicle transmission. The lubrication pump is expected to support a maximum operating speed of 5000 rpm and 95% volumetric efficiency in a heavy duty electric vehicle automatic 4-speed transmission. The conventional design of a gerotor pump provides two symmetric bean shaped ports at the suction and discharge sides, which are symmetric about the x-axis, as in FIG. 7. Research (as shown in FIG. 11) reveals that the conventional gerotor pump has the fill speed (maximum operating speed) at 3300 rpm and volumetric efficiency at 68%, both of which are less than the critical to quality (CTQ) requirements. It is happening because of insufficient filling of the pump cavity volume through the suction port at higher speed due to cavitation and thus, reduction in pump discharge flow. Therefore, there is a constant need for improving the design of the reversible gerotor pump to improve volume efficiency of the cavities and the filling and operating speed.

Figure 1C:
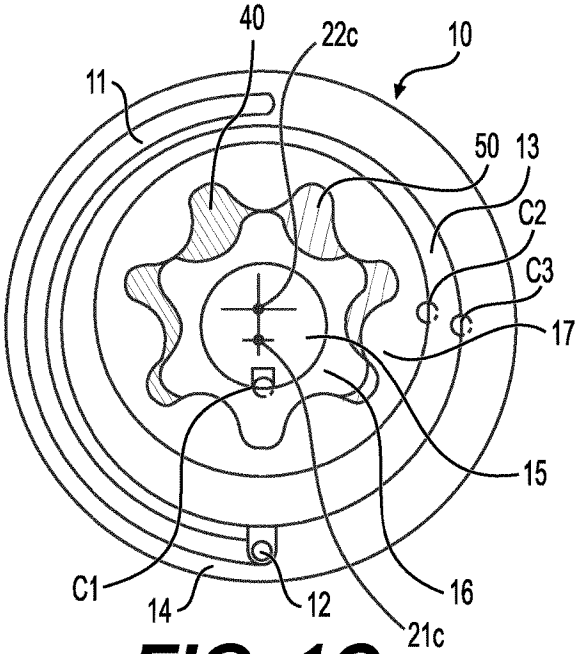
Figure 1A:
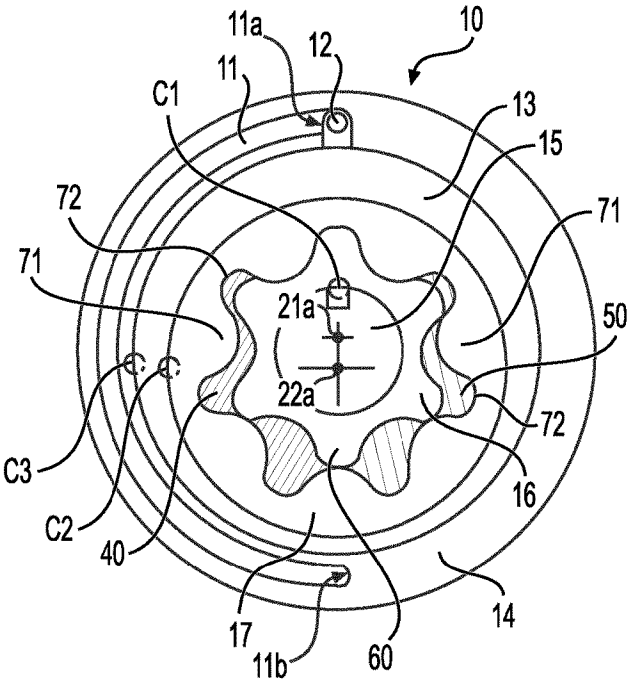

As shown in FIGS. 1A to 1C, the reversible gerotor pump 10 of the present invention comprises a cylindrical housing 14 with a slot 11 of 180 degree along a periphery of the housing. Slot 11 is defined by a first end 11*a* at the top and a second end 11*b* at the bottom. An eccentric ring 13 for adjusting eccentricity is positioned within housing 14, and radial clearance C3 is defined between eccentric ring 13 and housing 14. As shown in FIG. 1A, a locking pin 12 is fixed to the outer periphery of eccentric ring 13 at the thickest portion (along A-A' line in FIG. 2A) and movably engaged in slot 11 between the first end 11*a* and the second end 11*b* in housing 14.

An outer rotor 17 is positioned within eccentric ring 13, and radial clearance C2 is defined between eccentric ring 13 and outer rotor 17. Outer rotor 17 has a plurality of internal teeth 71 with recesses 72 defined between adjacent teeth 71. Outer rotor 17 and eccentric ring 13 are located eccentrically. An inner rotor 16 is positioned within outer rotor 17. Inner rotor 16 comprises a plurality of external teeth 60, where at least a portion of the external teeth 60 of inner rotor 16 are engaged with at least a portion of internal teeth 71 of outer rotor 17 at the recesses 72. Inner rotor 16 and outer rotor 17 are eccentric relative to one another. An inner rotor tip clearance Ci is defined as a radial clearance between the tip of the external tooth and the moveable portion of the outer rotor corresponding to the external tooth. A shaft 15 is coupled with inner rotor 16 for rotatably driving inner rotor 16. A radial clearance C1 is defined between shaft 15 and inner rotor 16.

Figure 6:
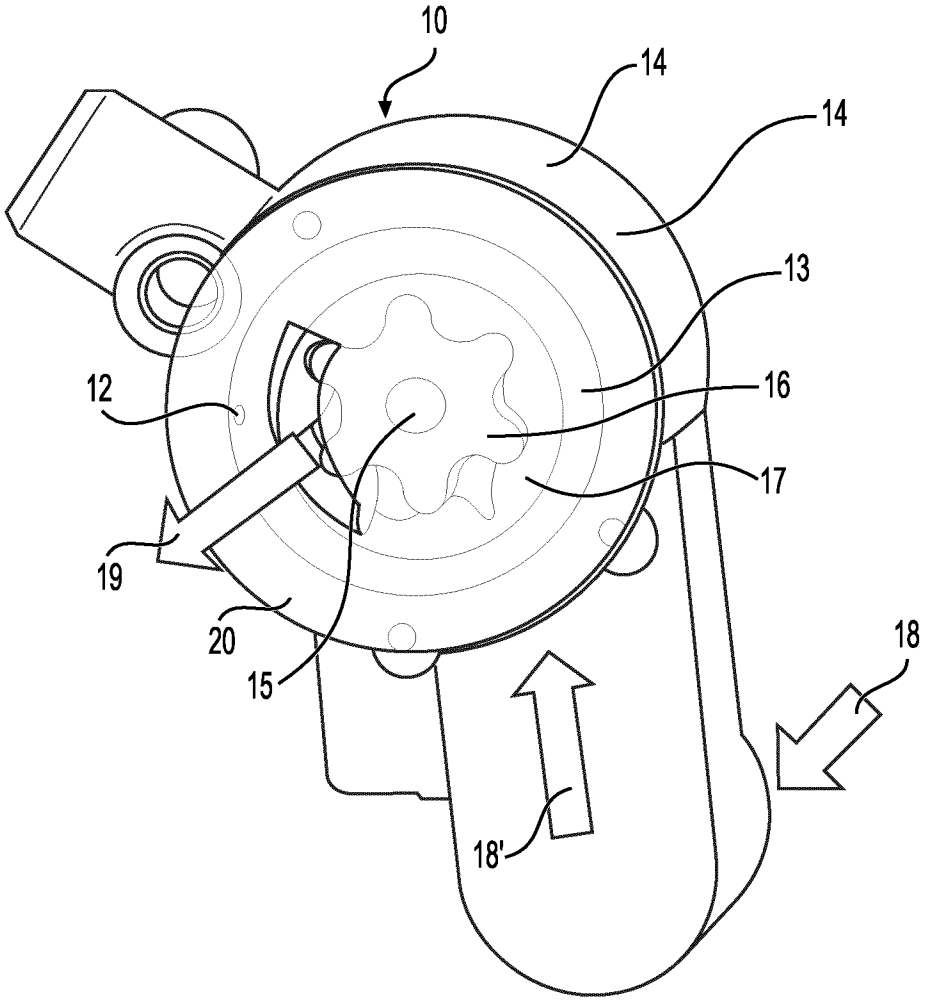
FIG. 6 shows the assembly of the reversible gerotor pump in the construction of the transmission for the vehicle.

When shaft 15 rotates and drives inner rotor 16 to rotate in the same direction, the plurality of meshed teeth 60 of inner rotor 16 and internal teeth 71 of outer rotor 17 form a plurality of cavities 50 and 50 that expand and contract as they rotate. While rotating, cavity 50 is being expanded and forms a basis for a sucking port and inlet (direction 18 and 18' as shown in FIG. 6), and cavity 40 is being contracted and forms a basis for a discharge port and outlet (direction 19 as shown in FIG. 6).

As shown in FIG. 1A, reversible gerotor pump 10 rotates clockwise and is in the first position. Locking pin 12 stops at the top, i.e., the first end 11*a*, and clockwise rotation of eccentric ring 13 is stopped, while inner rotor 16 and outer rotor 17 rotate clockwise with shaft 15 with the inlet and outlet function for suction and discharge, respectively. As reversible gerotor pump 10 is in clockwise rotation, each cavity formed between the external tooth 60 of inner rotor 16 and corresponding recess 72 of outer rotor 17, as illustrated by shaded area 50 on the right side in FIG. 1A, increases in volume, thus creating a vacuum and suction force to draw hydraulic liquid into the cavity through the inlet; at the same time, each cavity formed between the external tooth 60 of inner rotor 16 and corresponding recess 72 of outer rotor 17, as illustrated by shaded area 40 on the left side in FIG. 1A, decreases in volume, thus creating a pressure to discharge hydraulic fluid in the cavity through outlet. In the first position, reversible gerotor pump 10 of the present invention has contact at C1, C2, and C3 shown in FIG. 1A, and axel center 21*a* of shaft 15 is directly above axel center 22*a* of outer rotor 17. If shaft 15 rotates at speed +n, then, inner rotor 16 rotates at speed +n as well, outer rotor rotates at speed +n×(number of external teeth of inner rotor/number of interior teeth of outer rotor), and eccentric ring 13 is not rotating; contact force F ($F_1$ at C1 and $F_3$ at C3) is represented by formula (1):

$$F=T/r \quad (1),$$

where T is torque required to rotate reversible gerotor pump 10 and r is the radius at the contact.

When reversible gerotor pump 10 starts to rotate in the reversal direction, i.e., counterclockwise, it comes to the third position as shown in FIG. 1C through a second position shown in FIG. 1B. As shown in FIG. 1B, reversible gerotor pump 10 is in an intermediate (second) position where there are contact at C1 and C2 and eccentric ring 13, outer rotor 17, and inner rotor 16 rotate as one part with shaft 15. Reversible gerotor pump 10 will pass through the second position when shaft 15 changes rotation direction, such as from clockwise to counterclockwise or from counterclockwise to clockwise. When the rotation direction changes, eccentric ring 13 is driven to rotate in the reversed rotating direction by contact force between eccentric ring 13 and outer rotor 17 while locking pin 12 moves along slot 11 until it stops at the second end 11*b*, the bottom, to stop rotation of eccentric ring 13. In the second position, reversible gerotor pump 10 has contact at C1 and C2 as shown in FIG. 1B (axel center 21*b* of shaft 15 is at the same horizontal line as axel center 22*b* of outer rotor 17). If shaft 15 now rotates at speed −n, then, all inner rotor 16, outer rotor 17, and eccentric ring 13 rotate at speed −n; contact force $F_2$ at C2 in the second position is represented by formula (2):

$$F_2=mr\omega^2 \quad (2),$$

where m is the mass of eccentric ring 13, r is the radius at the contact C2, and ω is the angular speed of eccentric ring 13.

The condition to avoid sticking and achieving interior diameter contact on eccentric ring at C2 during the rotation direction change of shaft 15 is as in formula (3):

$$C3>\Sigma C1,C2,C1 \quad (3),$$

where C1 is the radial clearance between shaft 15 and inner rotor 16 at that position; C2 is the radial clearance between outer rotor 17 and eccentric ring 13 at that position, C3 is the radial clearance between eccentric ring 13 and housing 14 at that position, and Ci is inner rotor tip clearance between the tip of external tooth 60 and corresponding part of the outer rotor.

As shown in FIG. 1C, reversible gerotor pump 10 comes to the third position in the reversed rotation, i.e., counterclockwise, where eccentric ring 13 comes at the bottom, and shaft 15, along with inner rotor 16 and outer rotor 17, rotates counterclockwise. At the third position, locking pin 12 stops at the bottom, i.e., the second end 11*b*, and counterclockwise rotation of eccentric ring 13 is stopped, while inner rotor 16 and outer rotor 17 rotate counterclockwise with shaft 15, and directions of inlet 18 and 18', and direction of outlet 19 for suction and discharge are shown, respectively. As reversible gerotor pump 10 is in counterclockwise rotation, each cavity formed between the external tooth 60 of inner rotor 16 and corresponding recess 72 of outer rotor 17, as illustrated by shaded area 50 on the right side in FIG. 1C, increases in volume, thus creating a vacuum and suction force to draw hydraulic liquid into the cavity through the inlet; at the same time, each cavity formed between the external tooth 60 of inner rotor 16 and corresponding recess 72 of outer rotor 17, as illustrated by shaded area 40 on the left side in FIG. 1C, decreases in volume, thus creating a pressure to discharge hydraulic fluid in the cavity through the outlet. In the third position, reversible gerotor pump 10 has contact at C1, C2, and C3 shown in FIG. 1C, and axel center 21*c* of shaft 15 is directly below axel center 22*c* of outer rotor 17. If shaft 15 rotates at speed −n, then inner rotor 16 rotates at speed −n, outer rotor rotates at speed −n×(number of external teeth of inner rotor/number of interior teeth of outer rotor), and eccentric ring 13 is not rotating; contact force Fat contact points C1 and C3 is again represented by formula (1) as in the first position, where T is torque required to rotate reversible gerotor pump 10 and r is the radius at the contact point.

Figure 2B:
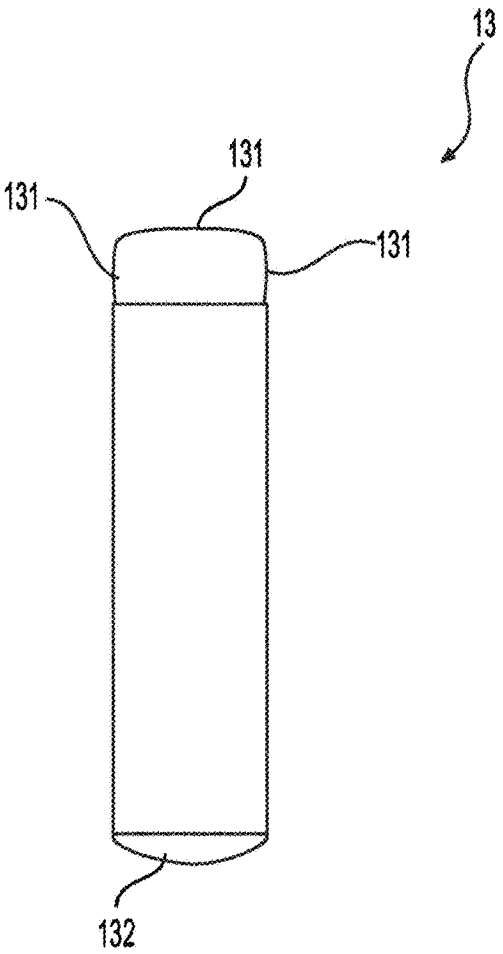
FIGS. 2A and 2B show the eccentric ring in the reversible gerotor pump, where
Figure 2A:
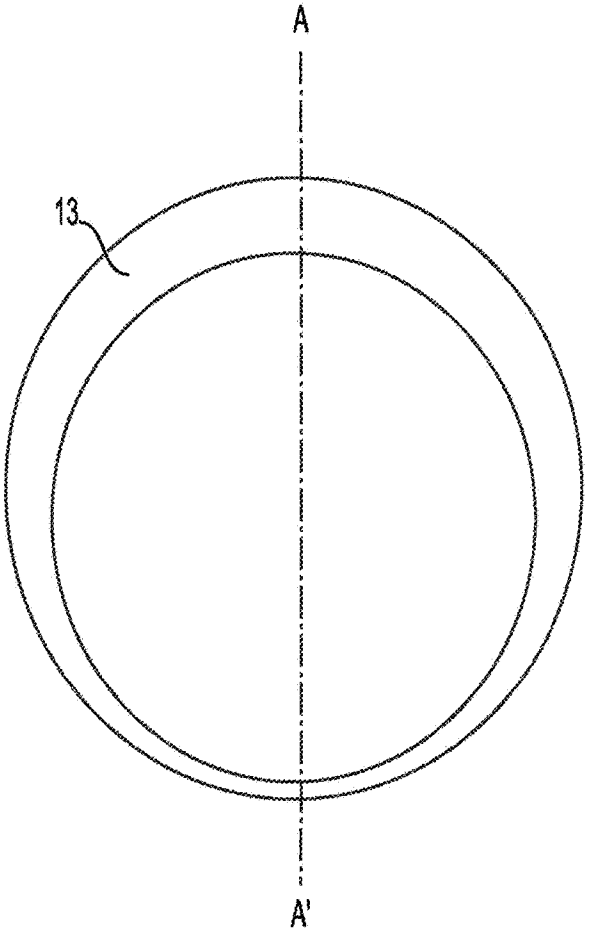

As shown in FIG. 2A, the outer periphery and internal shape of eccentric ring 13 are both cylindrical, however, they are not concentric while the thickness of eccentric ring 13 is distributed symmetrically along A-A' center line. The eccentric ring comprises an annulus of material, an inner circumference, and an outer circumference of the annulus, where the two circumferences are not concentric, thereby creating an eccentricity in the thickness of the eccentric ring. The thickness of the eccentric ring is uneven but distributed along the periphery of the circumference while symmetrically along the A-A' line. Locking pin 12 is fixed to the thickest part of eccentric ring 13. As shown in FIG. 2B, eccentric ring 13 has convex profile (131, 132) on the outer diameters and both sides, which helps to maintain lubrication file on the surface and keep line contact, instead of surface contact, in the second position as shown in FIG. 1B. The convex profile of eccentric ring 13 reduces tendency of sticking at the second position. When reversible gerotor pump 10 is in the first position as shown in FIG. 1A and third position as shown in FIG. 1C, the profile becomes flat on the outer diameter of eccentric ring 13 due to torque load.

During the reversal of rotation direction, it may occur that the inertia and convex profile of the eccentric ring are not able to overcome sticking. A positive contact mechanism can be provided to increase the frictional drag between the eccentric ring and rotating rotors and overcome sticking.

Figure 3B:
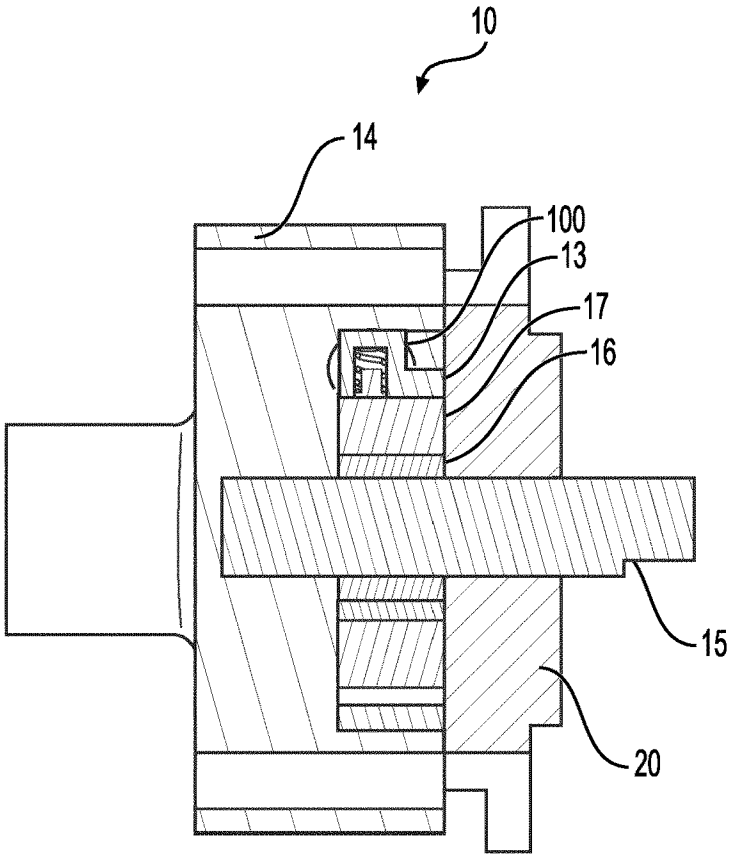
FIGS. 3A to 3C show one embodiment of the positive contact mechanism using a spring-and-plunger arrangement in the reversible gerotor pump, where
Figure 3A:
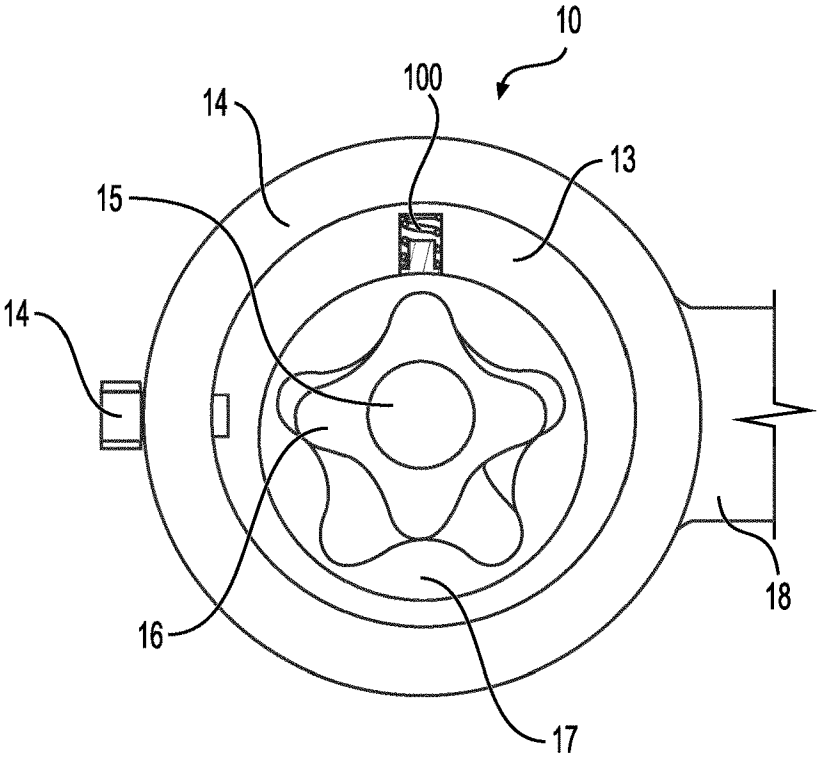
Figure 3C:
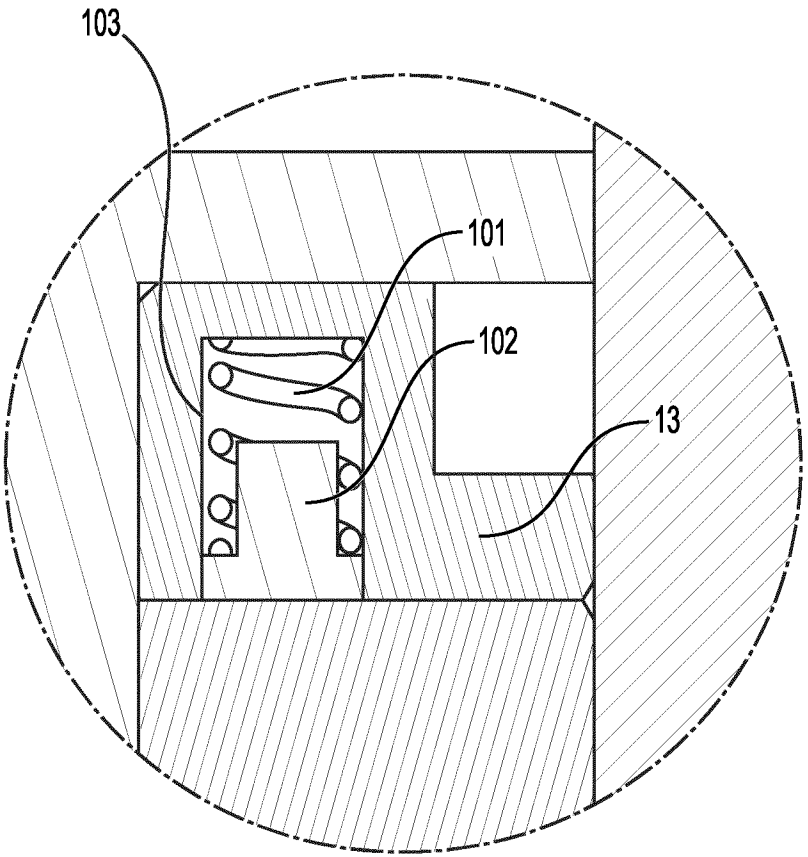

In the first embodiment of the positive contact system as shown in FIGS. 3A and 3B, positive contact mechanism 100 is provided at a higher thickness side of eccentric ring 13. As shown in the partially enlarged view in FIG. 3C, spring 101 and plunger 102 are arranged in cavity 103 such that spring 101 remains in compressed state. Due to the compression of spring 101, a load (N) is acting on outer rotor through plunger 102 according to the friction force formula (4):

$$F'=\mu*N \quad \text{equation (4)},$$

wherein F' is the friction force, N is the load, and μ is the coefficient that depends on the friction surface and working condition. Thus, an increase in the load (N) results in more friction force F which is capable of rotating eccentric ring 13. If required, plunger 102 can have Ferritic Nitro-Carburizing (FNC) friction coating which results in higher coefficient μ of the friction. FNC coating helps increase static coefficient of friction and reduce tendency of wear. Moreover, if cavity 103 is difficult to manufacture in eccentric ring 13, a drill through hole with a cap added at the outer diameter of eccentric ring 13 can be used.

Figure 4A:
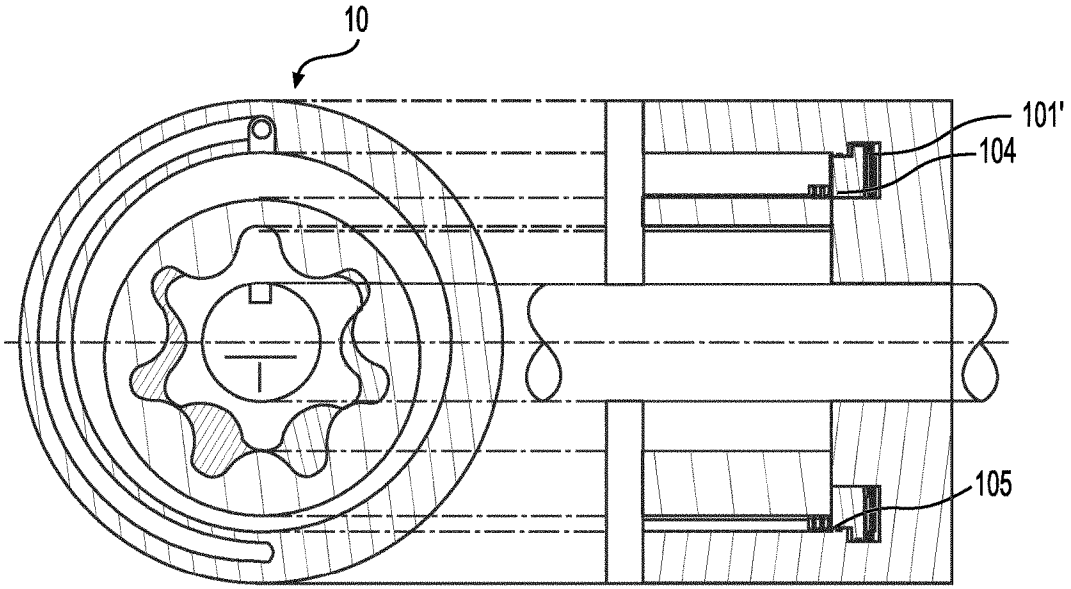
FIGS. 4A to 4C show another embodiment of the positive contact mechanism using a frictional disc brake type arrangement, where
Figure 4C:
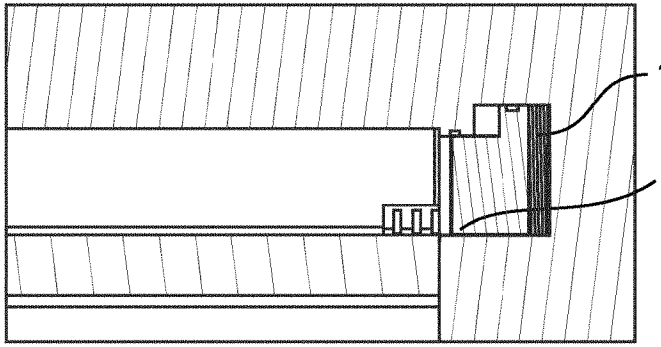
Figure 4B:
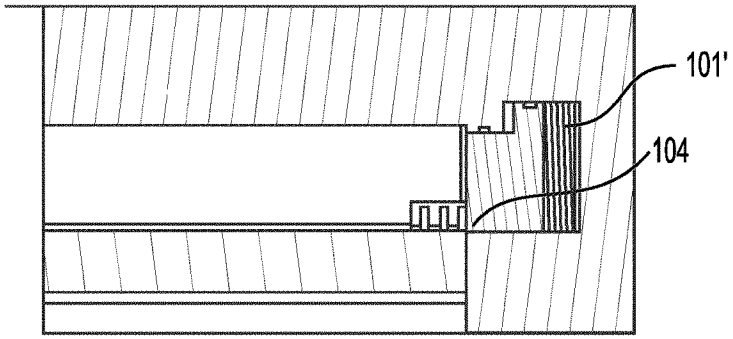

In the second embodiment of the positive contact system as shown in FIGS. 4A to 4C, a frictional disc brake type positive contact mechanism is provided. The positive contact system comprises spring, piston, and pads that are arranged on the pump system as in the frictional disc brake system. The working mechanism and components of the conventional frictional disc brake system is well known where, based on the Pascal Law, the force applied to the pad is proportional to the area of the pad in the system. The frictional disc brake type positive contact system in the present invention further provides added auto release function in addition to the frictional force. As shown in FIGS. 4A to 4C, a frictional disc brake type positive contact mechanism comprises spring 101', piston 104, and pad 105. As shown in FIG. 4B, spring 101' hold eccentric ring 13 and outer rotor 17 together with help of pads 105 and spring force at the second position. As shown in FIG. 4C, as the pump rotates, outlet pressure releases pads 105 and allow eccentric ring 13 and outer rotor 17 to rotate freely at the first and third positions. In application, when shaft 15 is rotating at slow speed during switching of rotation direction (from clockwise to counterclockwise or vice versa) or contact force $F_2$ in accordance with formula (2) in the second position is not sufficient to rotate eccentric ring 13, positive contact mechanism with friction disc brake pads 105 is especially useful. In one embodiment of the frictional disc brake positive contact system, the spring may be a Bellvile or wave spring that can be crushed by the fluid pressure and then expand to push the piston to the left and compress the friction discs. Friction discs would have a natural "compliance" whereby they expand when rotating to release grip.

Figure 5:
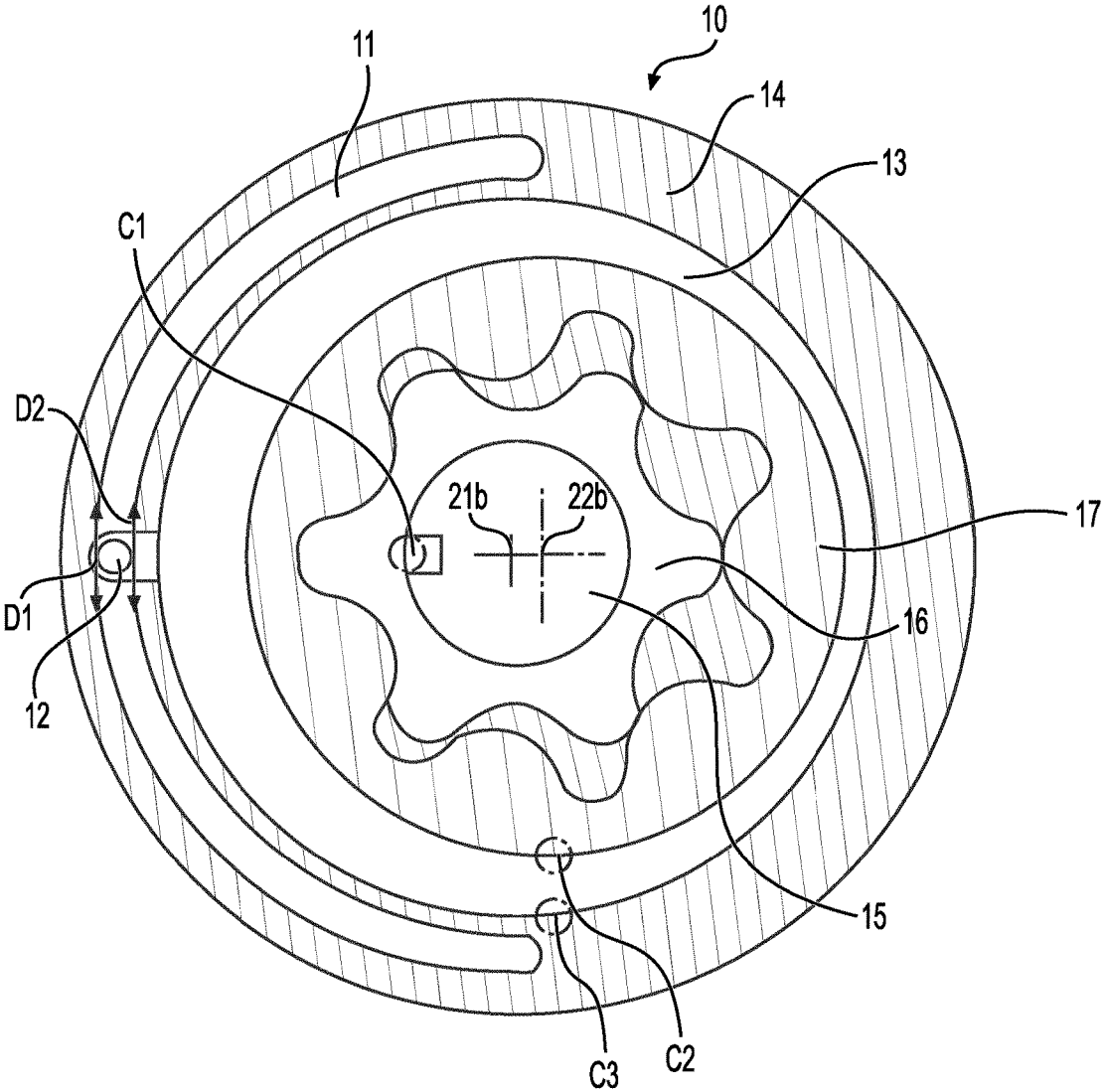
FIG. 5 shows the reversible gerotor pump of the present invention with clearance in movement of the locking pin within the slot of the housing to provide a self-damping mechanism.

Furthermore, in the reversible gerotor pump of the present invention, the locking pin moves within the slot in both directions with clearance. As shown in FIG. 5, clearance in both moving directions D1 and D2 provide self damping effect to avoid impact loading, locking pin 12 moves within the confinement of slot 11.

As shown in FIG. 6, reversible gerotor pump 10 of the present invention is assembled for use in vehicle transmission. Under outer plate 20, hydraulic fluid is sucked into reversible gerotor pump 10 through direction of inlet 18 and following direction 18' into the cavity between meshing teeth of inner rotor 16 and outer rotor 17, while outer rotor 17 is in eccentric ring 13 which is confined by locking pin 12 fixed thereto within housing 14. As shaft 15 rotates, inner and outer rotors rotate, and hydraulic fluid is discharged through direction of outlet 19.

The reversible gerotor pump can further comprise a novel design for the suction port with elongations at sides. As shown in FIGS. 1A to 1C, meshed teeth 60 of inner rotor 16 and teeth 71 of outer rotor 17 form regions called cavities 40 and 50, and some cavity expands in one side 50 and contracts in other side 40 of housing 14 as rotation of both rotors advances. Rotation of rotor forms multiple cavities between the rotor teeth.

Figure 7:
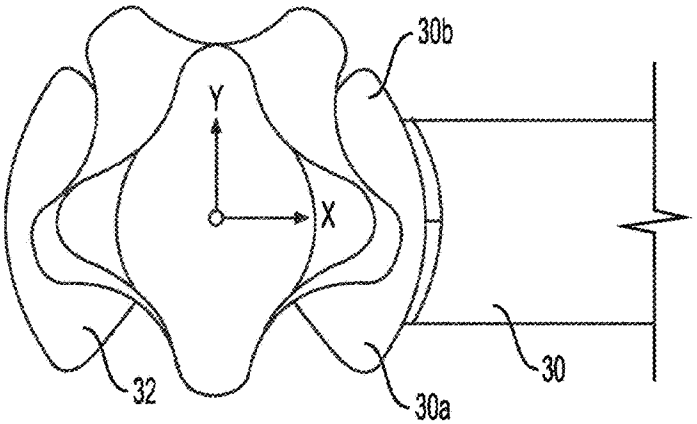
FIG. 7 PRIOR ART
FIG. 7 shows the suction and discharge ports for the gerotor pump in the prior art.

The suction port of the reversible gerotor pump decides the filling capability of cavity and helps to prevent cavitation. Further, at any angular position of rotation, the cavity should not connect discharge and suction ports at the same time, and inter-porting losses from the higher pressure region of the discharge port to the lower pressure region of the suction port should be avoided. As shown in FIG. 7, the conventional design of the gerotor pump includes the region in which expansion of cavity takes place and gives the basis to form a suction port 30, and similarly, a discharge port 32 is formed in the following contraction region. Suction port 30 and discharge port 32 are symmetric bean shaped ports at the suction and discharge side, respectively. The bean shaped suction port 30 includes upstream side 30*a* and downstream side 30*b*.

Figure 8B:
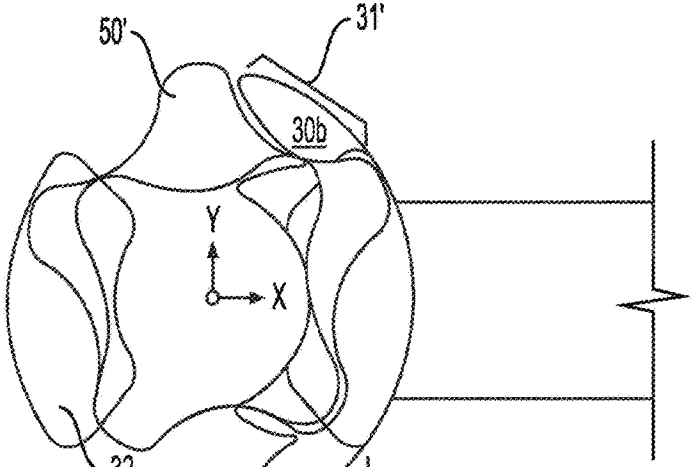
FIGS. 8A and 8B show the design of the suction port for the reversible gerotor pump of the present disclosure, where
Figure 8A:
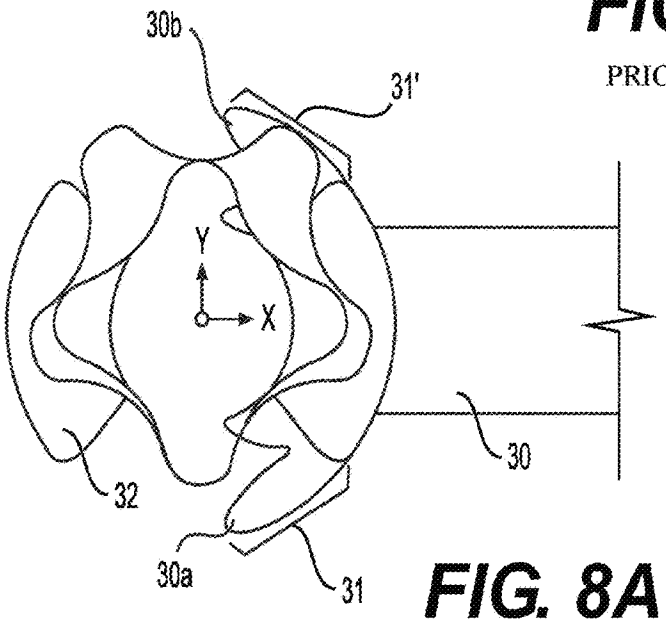

As the pump is reversible (bi-directional), the suction port 30 and the discharge port 32 are symmetric about x-axis. As shown in FIG. 8A, suction port 30 of the present invention is provided with prolongations 31 and 31' at both upstream side 30*a* and downstream side 30*b*, respectively. As shown in FIG. 8B, prolongation 31 at upstream side 30*a* of suction port 30 is provided to increase cavity filling time when rotor rotates in reverse direction, and prolongation 31' at downstream side 30*b* of suction port 30 is provided to increase cavity filling time when rotor rotates in clockwise direction. Cavity 50' in FIG. 8B shows that the cavity is about to connect to discharge port 32 and leave suction port 30, though the cavity should never connect discharge and suction ports at the same time to avoid inter-porting losses from the higher pressure region of the discharge port to the lower pressure region of the suction port.

Figure 9B:
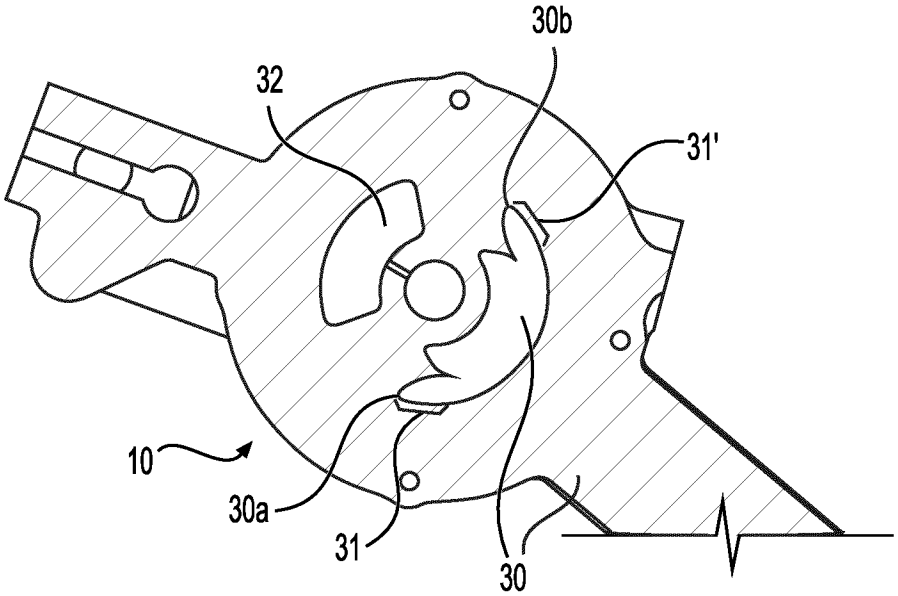
FIGS. 9A and 9B show the assembly and details of the suction port for the reversible gerotor pump, where
Figure 9A:
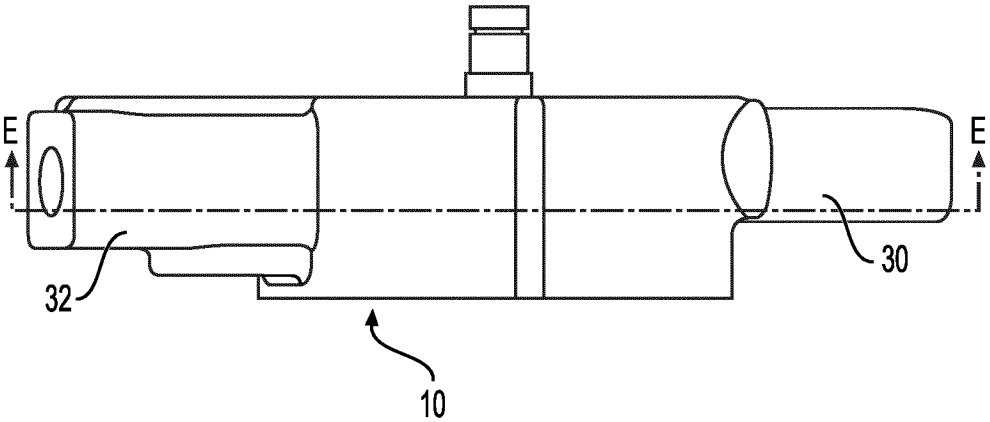

As further illustrated in FIGS. 9A and 9B, suction port 30 is terminating in the rotation direction of the rotor sets with two prolongations 31 and 31'. The shape and dimensions of prolongations 31 and 31' are designed such that suction and discharge ports do not connect to the same captured volume and inter-porting losses from high to low pressure side do not take place. Prolongation 31' at downstream side 30*b* direct more fluid into cavity to fill it substantially. Prolongation 31 at upstream side 30*a* of rotor are given for the same purpose when rotor is in reverse direction.

Figure 10A:
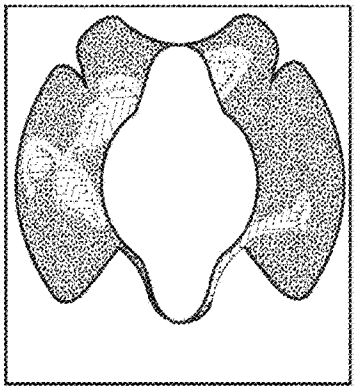
FIG. 10A PRIOR ART
FIGS. 10A to 10F show performance comparison in volume fraction between the conventional gerotor pump and the reversible gerotor pump with the suction port, where
Figure 10B:
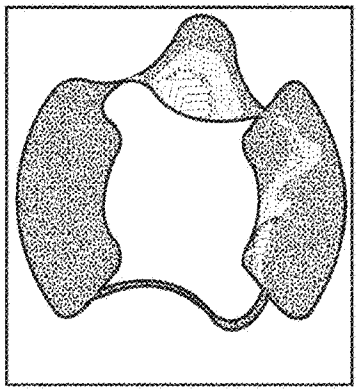
FIG. 10B PRIOR ART
Figure 10C:
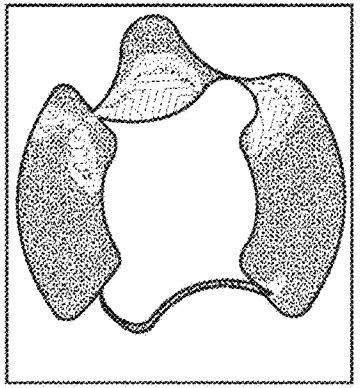
FIG. 10C PRIOR ART
Figure 10D:
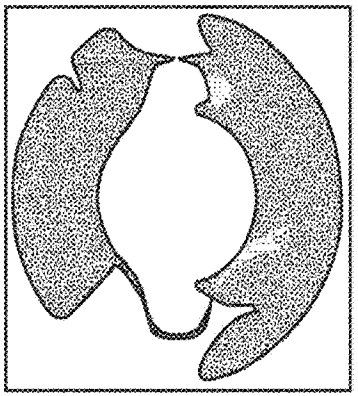
Figure 10E:
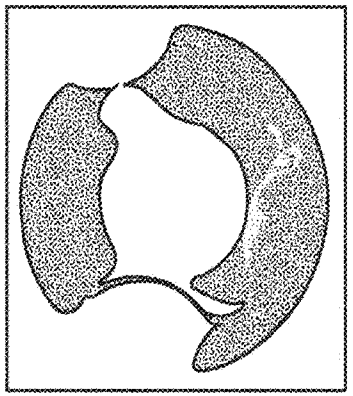
Figure 10F:
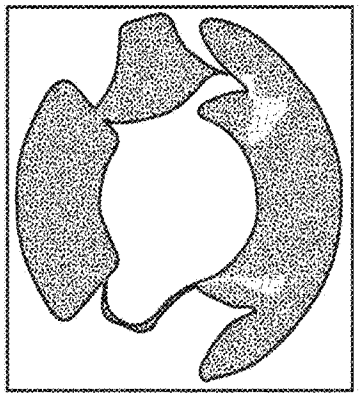

FIGS. 10A to 10F show analysis results for the vapor volume fraction for the conventional gerotor pump and the reversible gerotor pump with the prolongation at the suction port at 0 degree, 30 degree, and 60 degree of rotor rotation at 5000 rpm and 0.5 bar back pressure. As shown in FIGS. 10A and 10D, suction starts at 0 degree and advances in direction of rotation which is captured at 30 degree (FIGS. 10B and 10E) and 60 degree (FIGS. 10C and 10F). In conventional gerotor pump at 5000 rpm, at 0 degree as shown in FIG. 10A, the low pressure regions form at the upstream side on the right due to expansion of the cavity before suction port, and vapor fraction is carried from suction port as shown by the 3 large areas on the left; at 30 degree as shown in FIG. 10B, vapor intensity in the cavity at upstream side in FIG. 10A is getting reduced as it exposes to higher pressure fluid at suction port, while at the downstream side, vapor fraction is carried from suction port as seen at the upper portion of FIG. 10B; at 60 degree as shown in FIG. 10C, vapor formation can be seen at the downstream side of the suction port (right side) due to insufficient cavity filling, while on left side, a large vapor fraction is carried from the suction port to the discharge port. In summary, in the conventional design, as the cavity volume increases, the vapor fraction also increases because of insufficient filling, i.e., vapor at the discharge side is carried from the suction port (but it is not generated at the discharge port).

In comparison, in the reversible gerotor pump at 5000 rpm, at 0 degree as shown in FIG. 10D, the low pressure regions form at the upstream side on the right due to expansion of the cavity before suction port, while there is no vapor fraction carried from suction port on the left; at 30 degree as shown in FIG. 10E, as the prolongation on the suction port improves the cavity filling time which results in sufficient filling and prevents cavitation, the vapor intensity in the cavity moving towards the upstream side is getting further reduced as it exposes to higher pressure fluid at suction port, and there is no vapor fraction at the downstream side, and no vapor fraction is carried from suction port; at 60 degree as shown in FIG. 10F, no significant vapor formation is shown at the downstream side of the suction port (right side), while on inter-porting cavity on the top and at the left side, there is no vapor fraction. In summary, the reversible gerotor pump having the prolongations increases the cavity filling time which results in sufficient filling and prevent cavitation.

Figure 12:
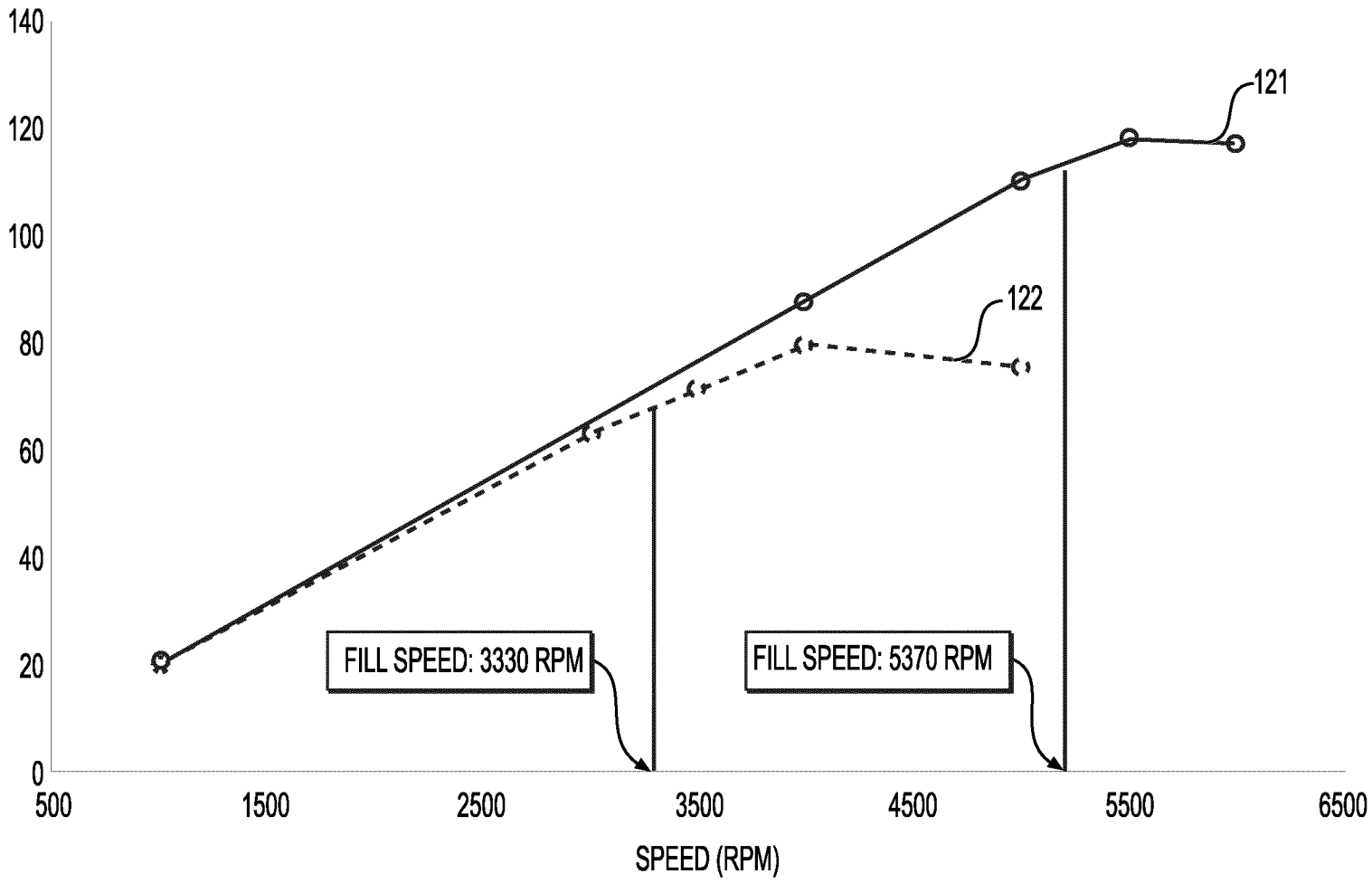
FIG. 12 is a diagram showing comparison of flow rate between the conventional gerotor pump (122) and the reversible gerotor pump with the suction port of the present disclosure (121), where the vertical axis represents the flow rate (LPM), and vertical lines show the fill speed.

As shown in FIG. 12, the fill speed of the pump improves to above 5000 rpm, and up to 5370 rpm in comparison to the conventional pump at 3330 rpm—an increase in the fill speed by 2040 rpm.

Figure 13:
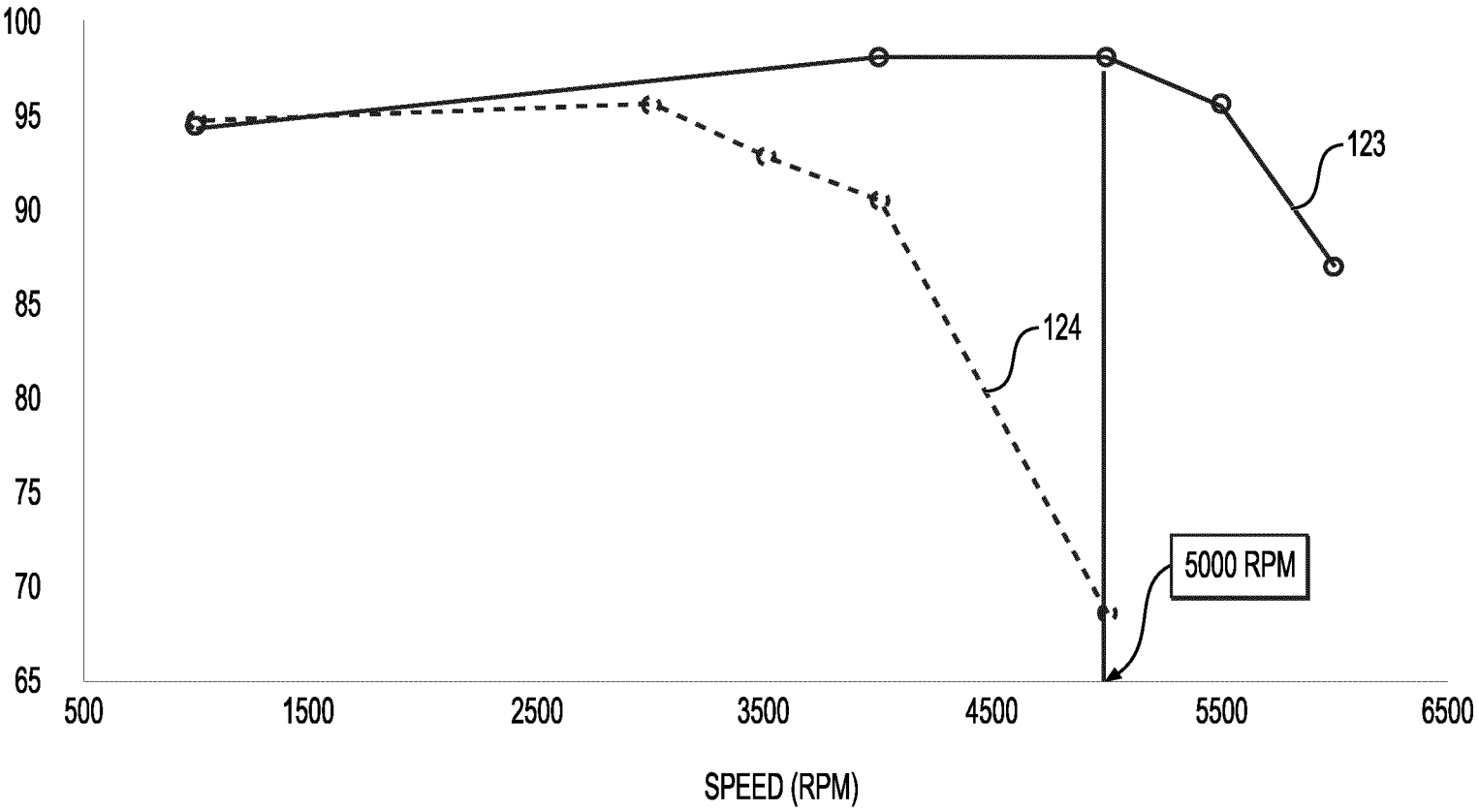
FIG. 13 is a diagram showing comparison of volumetric efficiency between the conventional gerotor pump (124) and the reversible gerotor pump with the suction port of the present disclosure (123), where the vertical axis represents the volumetric efficiency (%), and the vertical line shows the speed drawn at 5000 rpm.

As shown in FIG. 13, an increase in the volumetric efficiency of 29% is achieved, i.e., from 68% to 97%, at 5000 rpm speed, which exceeds the CTQ requirement. FIG. 13 shows that there is significant increase in the volumetric efficiency in the cavitation zone, that is, after 3330 rpm, and the volumetric efficiency increases even at lower pump speeds where cavitation is not taking place due to improved filling through the prolongations.

The prolongations on the suction port of the reversible gerotor pump system may be manufactured in all sizes of reversible gerotor pumps to improve the volumetric efficiency and maximum operating speed. The suction port of the reversible gerotor pump system can be implemented on any lubrication pump. It is beneficial in the transmission system for vehicles and is particularly useful for medium and heavy-duty electric vehicle transmissions, as an example. The reversible gerotor pump can be used in other applications than vehicle transmissions. It is easily manufacturable since High Pressure Die Casting (HPDC) is used to manufacture the pump housing. There is no addition in the weight of pump, and it is cost effective and helps to reduce the overall size of the port by reducing other dimensions, such as the depth and width of the port, while maintaining the required volumetric efficiency. The suction port meets all technology feasibility, manufacturability, and cost aspects.

The reversible gerotor lubrication pump provides a compact design due to the radial position of the eccentricity adjusting reversing ring. Self actuation based on the inertia of the eccentricity adjusting ring and the rotational friction during reversal operation eliminate the need for external actuation. The transmission gear gets lubrication from same port in either clockwise or counterclockwise direction of rotation with high pump volume and utilization rates, whether at slow or high speed.

A transmission system for vehicles can comprise the reversible gerotor pump system of the present disclosure. The reversible gerotor pump system can be used for supplying hydraulic fluid in the transmission system of any vehicles and is particularly useful in the transmission system for medium and heavy-duty electric vehicles. An electric vehicle can comprising the transmission system disclosed herein. The electric vehicle can be a heavy duty truck.

The description is exemplary in nature and one of skill would understand that variations are intended to be within the scope of the present invention.

We claim:

1. A reversible gerotor pump system, comprising a cylindrical housing comprising a slot of 180 degree along a periphery of the housing, and the slot being defined by a first end at top and a second end at bottom, an eccentric ring positioned within the housing with a radial clearance C3 between the eccentric ring and the housing, a locking pin being fixed to the eccentric ring and movably engaged between the first end and the second end in the slot, an outer rotor positioned within the eccentric ring with a radial clearance C2 between the eccentric ring and the outer rotor, the outer rotor being eccentric with the eccentric ring and comprising a plurality of internal teeth with recesses between adjacent teeth, an inner rotor positioned within the outer rotor, the inner rotor comprising a plurality of external teeth, wherein at least a portion of the external teeth of the inner rotor are engaged with at least a portion of the internal teeth of the outer rotor, and the inner rotor and the outer rotor are eccentric relative to one another with an inner rotor tip clearance Ci being defined as a radial clearance between a tip of the external teeth and corresponding portion of the outer rotor, and the plurality of meshed teeth of the inner rotor and the outer rotor form a plurality of cavities that expand and contract as the shaft, inner rotor, and outer rotor rotate;

a shaft being coupled with the inner rotor for rotatably driving the inner rotor with a radial clearance C1 between the shaft and the inner rotor, a suction port for providing hydraulic fluid to the cavity being expanded, the suction port comprising an upstream side and a downstream side, and a discharge port for discharging hydraulic fluid from the cavity being contracted, wherein the locking pin stops at the first end to stop rotation of the eccentric ring when the shaft rotates in clockwise direction in a first position;

when the shaft rotates in reverse direction, the eccentric ring is driven to rotate in counterclockwise rotation direction by contact force between the eccentric ring and the outer rotor to pass through a second position where the eccentric ring, the inner rotor, and the outer rotor rotate as one part along with the shaft, and the radial clearance C3 is greater than the sum of C1, C2, and Ci in the second position;

the locking pin stops at the second end to stop rotation of the eccentric ring when the shaft rotates in the counterclockwise direction in a third position; and the suction port and the discharge port respectively function for sucking and discharging a hydraulic fluid unidirectionally in both clockwise and counterclockwise rotation directions wherein the eccentric ring is of convex profile on outer diameter.

2. The reversible gerotor pump system of claim 1, wherein interior diameter contact is present at radial clearances C1 and C2 at the second position.

3. The reversible gerotor pump system of claim 1, further comprising a positive contact system, wherein the positive contact system increases frictional force between an interior side of the eccentric ring and the outer rotor for rotation.

4. The reversible gerotor pump system of claim 3, wherein a positive contact mechanism comprises a cavity at the interior side of the eccentric ring, a spring inside the cavity in a constantly compressed state, and a plunger inside the cavity and being constantly pressed by the spring, wherein compression of the spring applies a load N on the outer rotor through the plunger, and friction force F' of formula $F'=\mu*N$, $\mu$ is a coefficient of the frictional contact, is applied to rotate the eccentric ring with the outer rotor and inner rotor during rotation direction change.

5. The reversible gerotor pump system of claim 4, wherein the plunger is coated with a Ferritic Nitro-Carburizing (FNC) friction coating.

6. The reversible gerotor pump system of claim 4, wherein the cavity is formed by a drill through hole in the eccentric ring with a cap added at the outer diameter of the eccentric ring.

7. The reversible gerotor pump system of claim 1, wherein a positive contact system is a frictional disc brake type mechanism comprising spring, piston, and pads, and the frictional disc brake system provides spring force to hold the eccentric ring and the outer rotor at the second position, and outlet pressure releases pads and allow the eccentric ring and the outer rotor to rotate freely in the first and third positions.

8. The reversible gerotor pump system of the claim 1, wherein the locking pin moves in the slot with clearance at both clockwise and counterclockwise directions to provide a self-damping effect to avoid loading impact.

9. The reversible gerotor pump system of the claim 1, further comprising prolongations on the suction port at the upstream side and the downstream side, wherein the prolongations increase filling time for the cavities when the reversible gerotor pump system rotates.

10. The reversible gerotor pump system of the claim 9, wherein fill speed is above 5000 rpm.

11. The reversible gerotor pump system of the claim 10, wherein volumetric efficiency is at least 90% at 5000 rpm.

12. A transmission system for vehicles comprising the reversible gerotor pump system of claim 1.

13. An electric vehicle comprising the transmission system of claim 12.

14. The electric vehicle of claim 13, wherein the electric vehicle is a heavy duty truck.

* * * * *